US010316629B2

(12) United States Patent
Mason

(10) Patent No.: US 10,316,629 B2
(45) Date of Patent: Jun. 11, 2019

(54) PRESSURE-RESTRICTOR PLATE FOR A PARTIALLY LOADED PERFORATING GUN

(71) Applicant: Halliburton Energy Services, Inc., Houston, TX (US)

(72) Inventor: Justin Lee Mason, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 287 days.

(21) Appl. No.: 15/128,294

(22) PCT Filed: Jun. 18, 2014

(86) PCT No.: PCT/US2014/042916

§ 371 (c)(1),
(2) Date: Sep. 22, 2016

(87) PCT Pub. No.: WO2015/195114

PCT Pub. Date: Dec. 23, 2015

(65) Prior Publication Data

US 2017/0152732 A1 Jun. 1, 2017

(51) Int. Cl.
*E21B 43/117* (2006.01)
*E21B 43/119* (2006.01)
*F42D 1/04* (2006.01)

(52) U.S. Cl.
CPC ..... *E21B 43/119* (2013.01); *E21B 43/117* (2013.01); *F42D 1/04* (2013.01)

(58) Field of Classification Search
CPC ..... E21B 43/117; E21B 43/1195; E21B 43/119; E21B 43/11; E21B 43/263; F42B 1/02
See application file for complete search history.

(56) References Cited

U.S. PATENT DOCUMENTS 2,494,256 A * 1/1950 Muskat ..... C10G 61/06 175/4.56
2,587,723 A * 3/1952 Githens ..... E21B 43/116 175/4.5

(Continued)

FOREIGN PATENT DOCUMENTS

JP 2008501078 1/2008
WO 2013032456 3/2013

OTHER PUBLICATIONS

International Patent Application No. PCT/US2014/042916, International Search Report and Written Opinion dated Apr. 2, 2015, 15 pages.

*Primary Examiner* — Kipp C Wallace
(74) *Attorney, Agent, or Firm* — Kilpatrick Townsend and Stockton LLP

(57) ABSTRACT

As assembly for a pressure-restrictor plate for a partially loaded perforating gun is provided. The assembly can include a charge tube positioned in a loaded-gun section of a partially loaded perforating gun. The assembly can also include a pressure-restrictor plate positioned in a blank-gun section of the partially loaded perforating gun and adjacent to the charge tube. The assembly can further include a rod for securing the pressure-restrictor plate in a position, the rod having a first end that is coupled to the pressure-restrictor plate and a second end that is coupled to an end plate positioned within the partially loaded perforating gun.

18 Claims, 5 Drawing Sheets

(56) References Cited

U.S. PATENT DOCUMENTS

| | | | | | |
|---|---|---|---|---|---|
| 2,655,619 | A * | 10/1953 | Neal | E21B 43/1185 | 175/4.55 |
| 3,762,326 | A * | 10/1973 | Edgell | E21B 43/114 | 102/310 |
| 4,089,381 | A * | 5/1978 | Hallmark | E21B 43/117 | 102/310 |
| 4,676,309 | A * | 6/1987 | Gonzalez | E21B 43/117 | 166/55 |
| 5,046,567 | A * | 9/1991 | Aitken | E21B 43/117 | 102/200 |
| 5,054,564 | A * | 10/1991 | Oestreich | E21B 43/117 | 102/320 |
| 6,595,290 | B2 * | 7/2003 | George | E21B 43/116 | 166/255.2 |
| 8,127,654 | B2 * | 3/2012 | Williams | E21B 43/119 | 102/313 |
| 9,238,956 | B2 * | 1/2016 | Martinez | E21B 43/117 | |
| 9,926,755 | B2 * | 3/2018 | Van Petegem | E21B 41/005 | |
| 2004/0216632 | A1 * | 11/2004 | Finsterwald | F42D 1/043 | 102/310 |
| 2004/0216866 | A1 | 11/2004 | Barlow et al. | | |
| 2006/0102352 | A1 * | 5/2006 | Walker | E21B 43/119 | 166/297 |
| 2007/0079966 | A1 * | 4/2007 | George | E21B 43/117 | 166/297 |
| 2008/0149338 | A1 * | 6/2008 | Goodman | E21B 43/117 | 166/299 |
| 2010/0147519 | A1 | 6/2010 | Goodman et al. | | |
| 2010/0230104 | A1 * | 9/2010 | Nolke | E21B 33/14 | 166/297 |
| 2013/0153295 | A1 | 6/2013 | Rodgers et al. | | |
| 2015/0240607 | A1 * | 8/2015 | Hales | E21B 43/117 | 175/3.5 |

* cited by examiner

PRESSURE-RESTRICTOR PLATE FOR A PARTIALLY LOADED PERFORATING GUN

CROSS-REFERENCE TO RELATED APPLICATIONS

This is a U.S. national phase under 35 U.S.C. 371 of International Patent Application No. PCT/US2014/042916, titled "Pressure-Restrictor Plate For A Partially Loaded Perforating Gun" and filed Jun. 18, 2014, the entirety of which is incorporated herein by reference.

TECHNICAL FIELD

The present disclosure relates generally to devices for use in well systems. More specifically, but not by way of limitation, this disclosure relates to a pressure-restrictor plate for a partially loaded perforating gun.

BACKGROUND

A well system (e.g., an oil or gas well) can include a wellbore drilled for extracting hydrocarbons from a hydrocarbon reservoir in a subterranean formation. The wellbore can be drilled into or through the hydrocarbon reservoir to provide access to the targeted hydrocarbons. After the wellbore has been drilled, the wellbore is completed. Completing a wellbore can include running a casing into the wellbore to prevent the wellbore from closing on itself. Cement can be pumped into the space between the wall of the wellbore and the casing to seal the wellbore from extraneous fluid and fix the casing in the wellbore. Casing and cementing the wellbore, however, can also seal the wellbore from the hydrocarbon reservoir, inhibiting the extraction of the targeted hydrocarbons. It can be desirable to reestablish access to the hydrocarbon reservoir, typically by using a perforating gun.

A perforating gun can include an explosive device that can be positioned in a wellbore adjacent to a hydrocarbon reservoir. When detonated, the perforating gun can pierce portions of the lining (e.g., the casing and cement) of the wellbore, thereby making the hydrocarbon reservoir accessible. Detonating the perforating gun, however, can cause the perforating gun to structurally deform and become trapped in the wellbore. This can render the perforating gun or a wellbore section inoperable.

DETAILED DESCRIPTION

Figure 1:
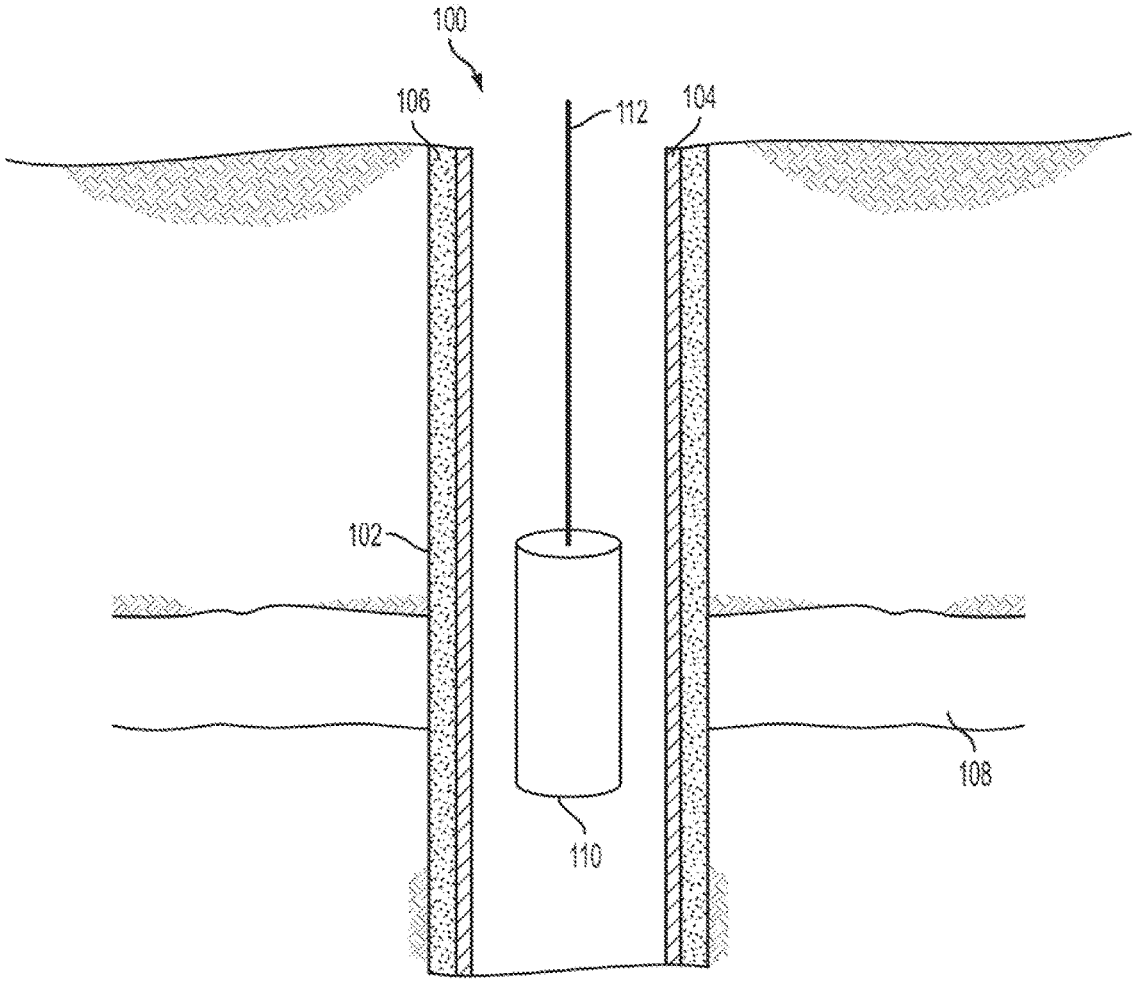
FIG. 1 is a cross-sectional view of a well system that can include a pressure-restrictor plate for a partially loaded perforating gun according to one embodiment of the present disclosure.

Certain aspects and features of the present disclosure are directed to a partially loaded perforating gun with a pressure-restrictor plate. The partially loaded perforating gun can include a charge tube for housing explosive charges. The charge tube may not extend through the full length of the partially loaded perforating gun, so that the partially loaded perforating gun is partially loaded, rather than fully loaded. The segment of a partially loaded perforating gun that includes the charge tube is referred to as the "loaded-gun section." The segment of the partially loaded perforating gun that does not include the charge tube is referred to as the "blank-gun section."

In some embodiments, the partially loaded perforating gun can include a pressure-restrictor plate. The pressure-restrictor plate can include a substantially cylindrical shape. The pressure-restrictor plate can be positioned between the blank-gun section and the loaded-gun section of the partially loaded perforating gun. The pressure-restrictor plate can create a pressure seal between the blank-gun section and the loaded-gun section of the partially loaded perforating gun. In some embodiments, a sealing device (e.g., an O-ring) can be positioned around the outer circumference of the pressure-restrictor plate, for example in a groove. The sealing device can enhance the pressure seal between the loaded-gun section and the blank-gun section of the partially loaded perforating gun.

In some embodiments, the pressure-restrictor plate can include an insert. The insert can include a substantially cylindrical shape with a smaller diameter than the diameter of the charge tube. The insert can be positioned within an end of the charge tube, for example, to help align or secure the pressure-restrictor plate between the loaded-gun section and the blank-gun section of the partially loaded perforating gun.

In some embodiments, the partially loaded perforating gun can include a rod. One end of the rod can be coupled to the pressure-restrictor plate. The other end of the rod can be coupled to an end plate. The end plate can be, or can be coupled to, a housing of the partially loaded perforating gun. The rod can help position or secure the pressure-restrictor plate between the loaded-gun section and the blank-gun section of the partially loaded perforating gun.

In one example, a partially loaded perforating gun can be positioned in a wellbore and adjacent to a hydrocarbon reservoir for piercing a lining (e.g., a casing) of the wellbore to access the hydrocarbon reservoir. The partially loaded perforating gun can include a pressure-restrictor plate. When detonated, the explosive charges in the loaded-gun section of the partially loaded perforating gun can emit one or more pressure waves. The pressure-restrictor plate can prevent the pressure waves from entering the blank-gun section of the partially loaded perforating gun to prevent the perforating gun from collapsing, rupturing, or deforming structurally. In some embodiments, the pressure waves can generate fractures or perforations in the wellbore lining, which can establish a way to access the hydrocarbon reservoir.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of a well system 100 for a pressure-restrictor plate for a partially loaded perforating gun according to one aspect of the present disclosure. The well system 100 (e.g., an oil or gas well for extracting fluids from a subterranean formation) includes a wellbore 102. The wellbore 102 can include a casing 104. The casing 104 can include multiple connected tubes of the same length or different lengths, or the same diameter or different diameters, positioned in the wellbore 102. In some embodiments, cement 106 can be disposed between the casing 104 and the wellbore 102. In other embodiments, the wellbore 102 can include the casing 104 but not the cement 106.

The well system 100 can further include a hydrocarbon reservoir 108. The hydrocarbon reservoir 108 can include the targeted hydrocarbons. A partially loaded perforating gun 110 can be positioned in the wellbore 102, for example, adjacent to the hydrocarbon reservoir 108. In some embodiments, the partially loaded perforating gun 110 can be positioned in the wellbore 102 by, for example, a wireline 112, a slickline, or a coiled tubing.

The partially loaded perforating gun 110 can include explosive charges. The explosive charges can be detonated, for example by a well operator, thereby piercing the lining (e.g., the casing 104 or cement 106) of the wellbore 102. Upon piercing the lining of the wellbore 102, the hydrocarbons can flow from the hydrocarbon reservoir 108 into the wellbore 102. The hydrocarbons can be used in or extracted from the well system 100.

Figure 2:
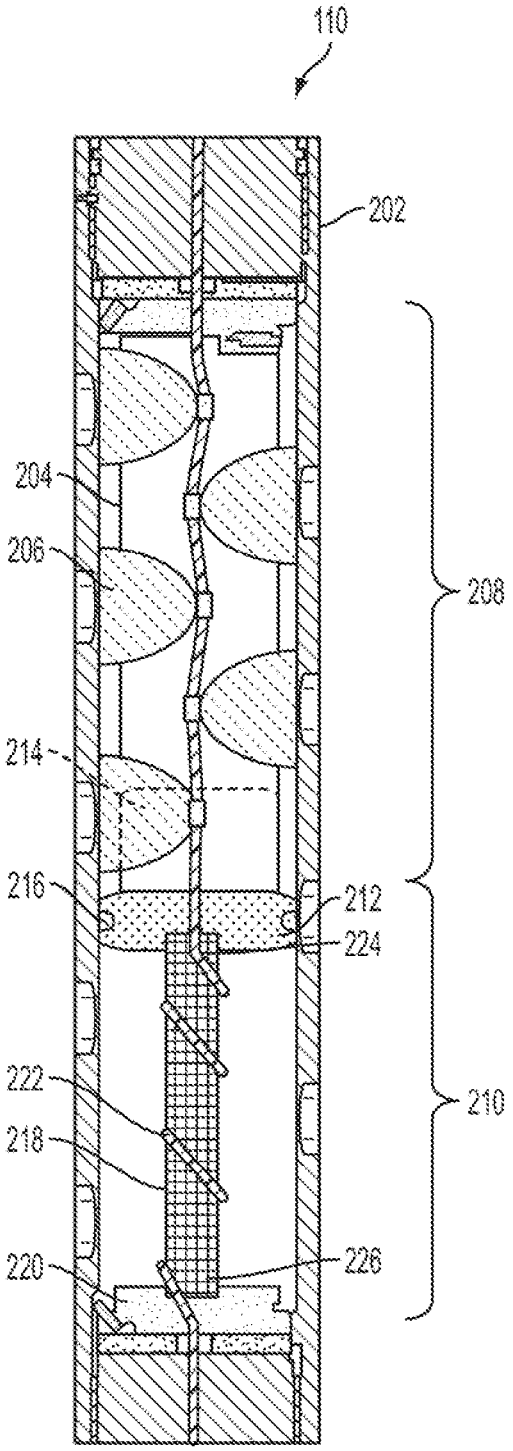
FIG. 2 is a cross-sectional side view of the partially loaded perforating gun shown in FIG. 1 according to one embodiment of the present disclosure.

FIG. 2 is a cross-sectional side view of the partially loaded perforating gun 110 shown in FIG. 1 according to one embodiment of the present disclosure. The partially loaded perforating gun 110 can include a housing 202. A charge tube 204 can be disposed within the housing 202. The charge tube 204 can include one or more explosive charges 206, and can position the explosive charges 206 in the partially loaded perforating gun 110. In some embodiments, the explosive charges 206 can be shaped charges.

A pressure-restrictor plate 212 can be positioned adjacent to the charge tube 204 and can fit within the housing 202 of the partially loaded perforating gun 110. The pressure-restrictor plate 212 can have a substantially cylindrical shape. In some embodiments, the pressure-restrictor plate 212 can include an insert 214. Although the embodiment shown in FIG. 2 depicts the insert 214 having a substantially cylindrical shape, the insert 214 can include any other suitable shape. For example, the insert 214 can include a cube shape. The insert 214 can have a smaller diameter than the charge tube 204 and can be positioned within an end of the charge tube 204. In some embodiments, positioning the insert 214 within the end of the charge tube 204 can help align or secure the pressure-restrictor plate 212 in place.

The pressure-restrictor plate 212 and the insert 214 can include one or more holes for communicating a detonation cord 222 between the blank-gun section 210 and the loaded-gun section 208 of the partially loaded perforating gun 110. The detonation cord 222 can be coupled to the explosive charges 206 for detonating the partially loaded perforating gun 110.

The pressure-restrictor plate 212 can separate and define the boundaries of the loaded-gun section 208 and the blank-gun section 210. In some embodiments, the pressure-restrictor plate 212 can create a pressure seal between the loaded-gun section 208 and blank-gun section 210 of the partially loaded perforating gun 110. The pressure-restrictor plate 212 can include any suitable material. An example of a suitable material is metal, such as steel. In some embodiments, one or more sealing devices 216, such as O-rings, can be coupled to the pressure-restrictor plate 212 for creating or enhancing the pressure seal between the loaded-gun section 208 and blank-gun section 210. Unlike with traditional partially loaded perforating guns, upon detonating the partially loaded perforating gun 110, the pressure-restrictor plate 212 can prevent pressure waves from the loaded-gun section 208 from entering the blank-gun section 210. This can prevent the partially loaded perforating gun 110 from collapsing, rupturing, or deforming structurally.

The partially loaded perforating gun 110 can include a rod 218. The rod 218 can include any suitable material. An example of a suitable material is metal, such as steel. In some embodiments, one end 224 of a rod 218 can be coupled to the pressure-restrictor plate 212 and the other end 226 of the rod 218 can be coupled to an end plate 220. The end plate 220 can be a part of, or can be positioned within, a housing 202 of the partially loaded perforating gun 110. The rod 218 can be coupled to the pressure-restrictor plate 212 or the end plate 220 by, for example, a threaded connection, an insert, or by welding. The rod 218 can be hollow in some examples. In some embodiments, the length of the rod 218 can be adjustable. For example, the length of the rod 218 can be selectively modified for positioning the pressure-restrictor plate 212 in the partially loaded perforating gun 110. The detonation cord 222 can be wrapped around the rod 218 or disposed within the rod 218 (e.g., if the rod 218 is hollow) for communicating a detonation signal to the explosive charges 206.

Although the embodiment shown in FIG. 2 depicts the blank-gun section 210 positioned in the longitudinal bottom of the partially loaded perforating gun 110 and the loaded-gun section 208 positioned in the longitudinal top of the partially loaded perforating gun 110, the positions of the blank-gun section 210 and the loaded-gun section 208 can be switched. For example, the blank-gun section 210 can be positioned in the longitudinal top of the partially loaded perforating gun 110 and the loaded-gun section 208 can be positioned in the longitudinal bottom of the partially loaded perforating gun 110. Further, in some embodiments, the partially loaded perforating gun 110 can include multiple blank-gun sections 210, multiple loaded-gun sections 208, multiple pressure-restrictor plates 212, multiple rods 218 (described further with respect to FIG. 5), or multiples of any combination of these.

Figure 3:
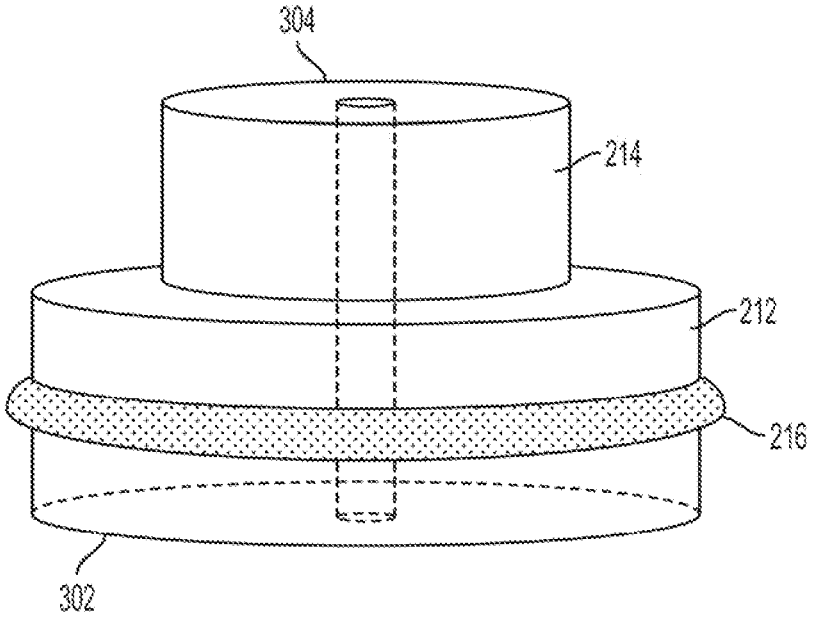
FIG. 3 is a side view of a pressure-restrictor plate according to one embodiment of the present disclosure.
Figure 4:
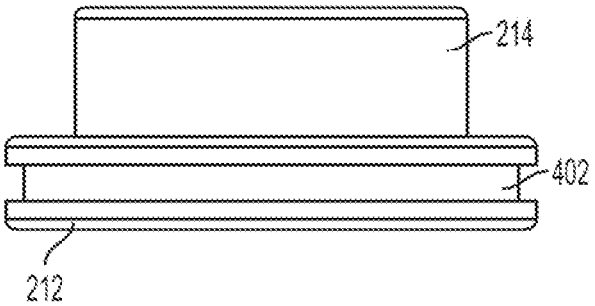
FIG. 4 is a side view of a pressure-restrictor plate according to another embodiment of the present disclosure.

FIG. 3 is a side view of a pressure-restrictor plate 212 according to one embodiment of the present disclosure. As described above, in some embodiments, the pressure-restrictor plate 212 can include a cylindrical shape or a circular shape. Further, the pressure-restrictor plate 212 can include an insert 214. The insert 214 can include a cylindrical shape, or any other suitable shape. Further, in some embodiments, one or more sealing devices 216 can be coupled to the pressure-restrictor plate 212, such as being coupled to the outer circumference of the pressure-restrictor plate 212. The sealing devices 216 can create or enhance a pressure seal between the blank-gun section and the loaded-gun section of the partially loaded perforating gun. In some embodiments, the pressure-restrictor plate can include a channel or groove (for example, the groove 402 shown in FIG. 4). The channel or groove can be positioned around the outer circumference of the pressure-restrictor plate 212, for example, for receiving the sealing device 216.

In some embodiments, a rod (not shown) can be coupled to the bottom 302 of the pressure-restrictor plate 212, for example, to the cross-sectional center of the bottom 302 of the pressure-restrictor plate 212. Further, in some embodiments, the pressure-restrictor plate 212 and the insert 214 can include a hole 304, for example, for threading a detonation cord between the blank-gun section and the loaded-gun section of the partially loaded perforating gun. Although the hole 304 is depicted in FIG. 3 as including a circular cross-sectional end shape, in other embodiments, the hole 304 can include any suitable shape. Some examples of a suitable shape can include a rectangular, square, oval, or a triangular shape.

Figure 5:
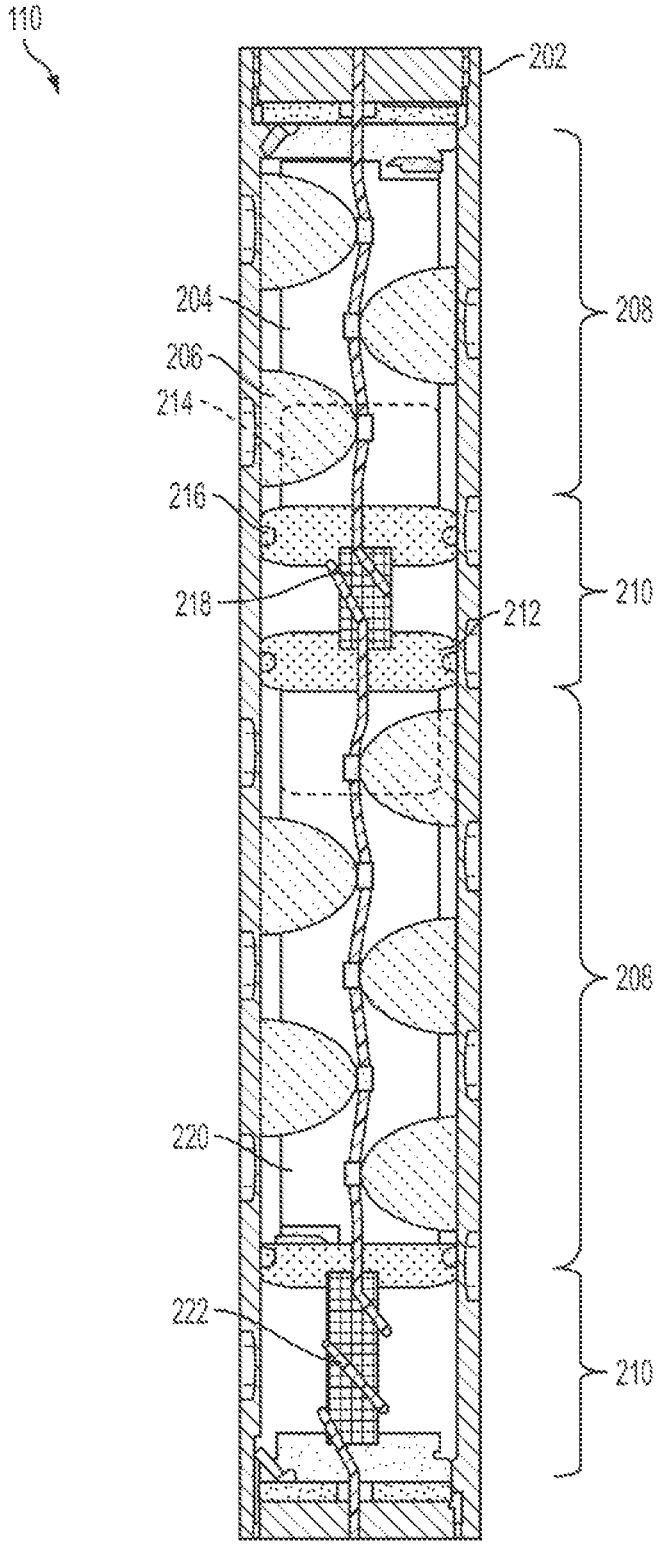
FIG. 5 is a cross-sectional side view of the partially loaded perforating gun shown in FIG. 1 according another embodiment of the present disclosure.

FIG. 5 is a cross-sectional side view of the partially loaded perforating gun shown in FIG. 1 according another embodiment of the present disclosure. In this example, the partially loaded perforating gun 110 includes multiple blank-gun sections 210 and multiple loaded-gun sections 208. The partially loaded perforating gun 110 can include any number of loaded-gun sections 208 and any number of blank-gun sections 210.

The partially loaded perforating gun 110 can include multiple pressure restrictor plates 212. A pressure-restrictor plate 212 can be positioned for separating each of the multiple blank-gun sections 210 from each of the multiple loaded-gun sections 208. The pressure-restrictor plates 212 can perform substantially the same functions and have substantially the same characteristics as the pressure-restrictor plate 212 described with respect to FIGS. 2-4. In some embodiments, one or more pressure-restrictor plates 212 can include an insert 214. The insert 214 can be positioned within an end of a charge tube 204 in a loaded-gun section 208. Further, in some embodiments, the one or more pressure-restrictor plates 212 can include a hole, for example, for communicating a detonation cord between a blank-gun section 210 and a loaded-gun section 208 of the partially loaded perforating gun.

The partially loaded perforating gun 110 can also include multiple rods 218. In some embodiments, a rod 218 can be coupled to a pressure-restrictor plate 212 on one end, and to an end plate 220 on the other end. The end plate 220 can be a part of, or be positioned within, the housing 202 of the partially loaded perforating gun 110. In other embodiments, a rod 218 can be coupled on each end to a different pressure-restrictor plate 212. For example, one end of the rod 218 can be coupled to one pressure-restrictor plate 212 and another end of the rod 218 coupled to another pressure-restrictor plate 212.

Figure 6:
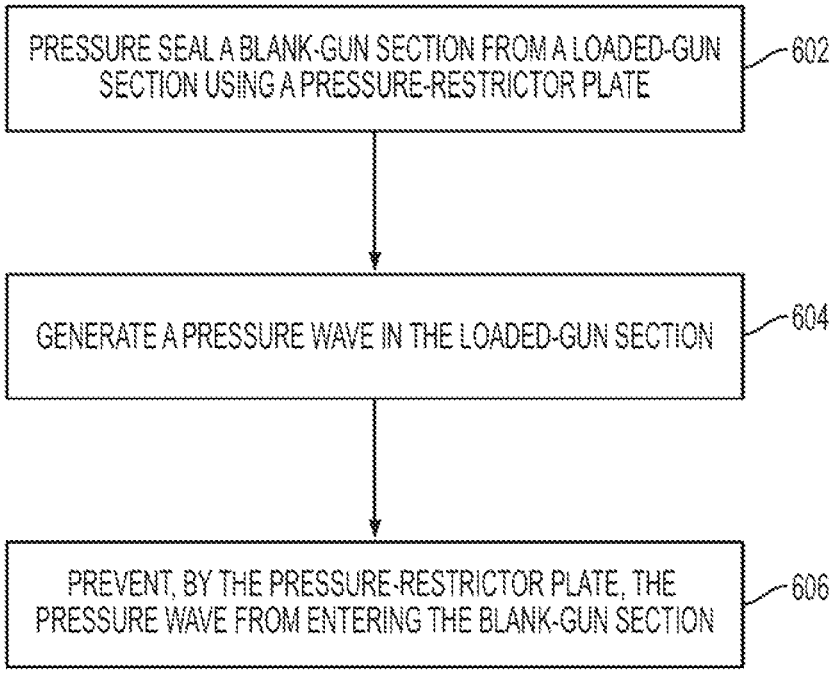
FIG. 6 is an example of a flow chart of a process for using a pressure-restrictor plate for a partially loaded perforating gun according to one embodiment of the present disclosure.

FIG. 6 is an example of a flow chart of a process for using a pressure-restrictor plate for a partially loaded perforating gun according to one embodiment of the present disclosure.

In block 602, a pressure-restrictor plate creates a pressure seal between a blank-gun section and a loaded-gun section of a partially loaded perforating gun. The pressure-restrictor plate can be positioned between the blank-gun section and the loaded-gun section of the partially loaded perforating gun. In some embodiments, the pressure-restrictor plate can be positioned within the blank-gun section and adjacent to the loaded-gun section of the partially loaded perforating gun. Further, in some embodiments, the pressure-restrictor plan can include a groove for receiving a sealing device (e.g., an O-ring) for enhancing the pressure seal between the blank-gun section and the loaded-gun section of the partially loaded perforating gun. The partially loaded perforating gun can be positioned in a wellbore.

In block 604, a pressure wave is generated in the loaded-gun section. The pressure wave can be generated by detonating one or more explosive charges in the loaded-gun section.

In some embodiments, an electrical signal or other ignition source (e.g., fire) can be transmitted to one or more detonation cords coupled to one or more explosive charges within the partially loaded perforating gun. For example, an electrical signal can be transmitted from a power source via a wireline to the one or more detonation cords within the loaded-gun section. The electrical signal or other ignition source can travel through the detonation cord, which can cause the one or more explosive charges to detonate. Detonating the one or more explosive charges can generate one or more pressure waves in the loaded-gun section of the partially loaded perforating gun.

In block 606, the pressure-restrictor plate can prevent the pressure wave from entering the blank-gun section of the partially loaded perforating gun. The pressure-restrictor plate can create a pressure seal to prevent the pressure wave from entering the blank-gun section. Preventing the pressure wave from entering the blank-gun section can prevent the perforating gun from collapsing, rupturing, or deforming structurally.

In some aspects, a system for a pressure-restrictor plate for a partially loaded perforating gun is provided according to one or more of the following examples.

Example #1

An assembly can include a charge tube that can be positioned in a loaded-gun section of a partially loaded perforating gun. The assembly can also include a pressure-restrictor plate that can be positioned between a blank-gun section of the partially loaded perforating gun and adjacent to the charge tube. The assembly can further include a rod for securing the pressure-restrictor plate in a position, the rod having a first end that can be coupled to the pressure-restrictor plate and a second end that can be coupled to an end plate positioned within the partially loaded perforating gun.

Example #2

The assembly of Example #1 may feature the partially loaded perforating gun including a perforating gun in which the charge tube does not extend a full longitudinal length of the perforating gun.

Example #3

The assembly of any of Examples #1-2 may feature a second pressure-restrictor plate, a second blank-gun section, and a second rod. The second rod can be coupled to the second pressure-restrictor plate and can be positioned within the second blank-gun section.

Example #4

The assembly of any of Examples #1-3 may feature an O-ring positioned in a groove around an outer circumference of the pressure-restrictor plate.

Example #5

The assembly of any of Examples #1-4 may feature the pressure-restrictor plate including a hole for communicating a detonation cord between the blank-gun section and the loaded-gun section.

Example #6

The assembly of any of Examples #1-5 may feature an insert coupled to the pressure-restrictor plate for aligning or securing the pressure-restrictor plate adjacent to the charge tube.

Example #7

The assembly of Example #6 may feature the insert being positionable within an end of the charge tube.

Example #8

The assembly of any of Examples #1-7 may feature the charge tube including multiple shaped charges.

Example #9

The assembly of any of Examples #1-8 may feature the pressure-restrictor plate positioned for separating the blank-gun section from the loaded-gun section.

Example #10

The assembly of any of Examples #1-9 may feature the pressure-restrictor plate positioned for creating a pressure seal between the blank-gun section and the loaded-gun section.

Example #11

An assembly can include a loaded-gun section of a partially loaded perforating gun. The loaded-gun section can include multiple explosive charges. The assembly can also include a pressure-restrictor plate. The pressure-restrictor plate can be positioned for separating the loaded-gun section from a blank-gun section of the partially loaded perforating gun and generating a pressure seal between the loaded-gun section and the blank-gun section.

Example #12

The assembly of Example #11 may feature the partially loaded perforating gun including a perforating gun in which the loaded-gun section does not extend a full longitudinal length of the perforating gun.

Example #13

The assembly of any of Examples #11-12 may feature an O-ring positioned in a groove around an outer circumference of the pressure-restrictor plate.

Example #14

The assembly of any of Examples #11-13 may feature the pressure-restrictor plate including a hole for communicating a detonation cord between the blank-gun section and the loaded-gun section.

Example #15

The assembly of any of Examples #11-14 may feature an insert coupled to the pressure-restrictor plate for aligning or securing the pressure-restrictor plate adjacent to the charge tube.

Example #16

The assembly of Example #15 may feature the insert being positionable within an end of the charge tube.

Example #17

The assembly of any of Examples #11-16 may feature a rod coupled to the pressure-restrictor plate and an end plate for securing the pressure-restrictor plate in a position, the end plate disposed within a housing of the partially-loaded perforating gun.

Example #18

The assembly of any of Examples #11-17 may feature multiple pressure-restrictor plates, multiple blank-gun sections, and multiple rods. Each of the multiple rods can be coupled to at least one of the multiple pressure-restrictor plates and can be positioned within one of the multiple blank-gun sections.

Example #19

A method can include pressure sealing, by a pressure-restrictor plate, a blank-gun section of a partially loaded perforating gun from a loaded-gun section of the partially loaded perforating gun. The partially loaded perforating gun can be positioned in a wellbore. The method can also include generating a pressure wave in the loaded-gun section. The method can further including preventing, by the pressure-restrictor plate, the pressure wave from entering the blank-gun section.

Example #20

The method of Example #19 may feature generating, by the pressure wave, multiple perforations in the lining of the wellbore.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly, comprising:

a charge tube positioned in a loaded-gun section of a partially loaded perforating gun, wherein the charge tube extends through a first longitudinal length of the partially loaded perforating gun corresponding to the loaded-gun section, and wherein the loaded-gun section comprises a plurality of explosive charges;

a blank-gun section of the partially loaded perforating gun extending through a second longitudinal length of the partially loaded perforating gun separate from the first longitudinal length, wherein the blank-gun section excludes the charge tube;

a pressure-restrictor plate positioned in the blank-gun section of the partially loaded perforating gun and adjacent to the charge tube for generating a pressure seal between the loaded-gun section and the blank-gun section; and a rod for securing the pressure-restrictor plate in position, the rod having a first end that is coupled to the pressure-restrictor plate and a second end that is coupled to an end plate positioned within the blank-gun section of the partially loaded perforating gun, wherein the rod extends through the blank-gun section from the pressure-restrictor plate to the end plate.

2. The assembly of claim 1, wherein the partially loaded perforating gun comprises a perforating gun wherein the charge tube does not extend a full longitudinal length of the perforating gun.

3. The assembly of claim 1, further comprising:

a second charge tube positioned in a second loaded-gun section of the partially loaded perforating gun and extending through a third longitudinal length of the partially loaded perforating gun;

a second blank-gun section extending through a fourth longitudinal length of the partially loaded perforating gun separate from the third longitudinal length, wherein the second blank-gun section excludes the second charge tube;

a second pressure-restrictor plate positioned in the second blank-gun section of the partially loaded perforating gun and adjacent to the second charge tube; and a second rod for securing the second pressure-restrictor plate in position, the second rod having a first end coupled to the second pressure-restrictor plate and a second end, wherein the second rod extends through the second blank-gun section.

4. The assembly of claim 1, further comprising an O-ring positioned in a groove around an outer circumference of the pressure-restrictor plate.

5. The assembly of claim 1, wherein the pressure-restrictor plate further comprises a hole for communicating a detonation cord between the blank-gun section and the loaded-gun section.

6. The assembly of claim 1, further comprising an insert coupled to the pressure-restrictor plate for aligning or securing the pressure-restrictor plate adjacent to the charge tube.

7. The assembly of claim 6, wherein the insert is positionable within an end of the charge tube.

8. The assembly of claim 1, wherein the charge tube comprises a plurality of shaped charges.

9. The assembly of claim 1, wherein the pressure-restrictor plate is positioned for separating the blank-gun section from the loaded-gun section.

10. The assembly of claim 3, wherein the second rod is coupled at the second end to the pressure-restrictor plate.

11. An assembly, comprising;

a loaded-gun section of a partially loaded perforating gun, wherein the loaded-gun section comprises a plurality of explosive charges housed within a charge tube extending through a longitudinal length of the partially loaded perforating gun; and a pressure-restrictor plate positioned for separating the loaded-gun section from a blank-gun section of the partially loaded perforating gun and generating a pressure seal between the loaded-gun section and the blank-gun section, wherein the blank-gun section excludes the charge tube; and a rod for securing the pressure-restrictor plate in position, the rod having a first end that is coupled to the pressure-restrictor plate and a second end that is coupled to an end plate positioned within the blank-gun section, wherein the rod extends through the blank-gun section.

12. The assembly of claim 11, wherein the partially loaded perforating gun comprises a perforating gun wherein the loaded-gun section does not extend a full longitudinal length of the perforating gun.

13. The assembly of claim 11, further comprising an O-ring positioned in a groove around an outer circumference of the pressure-restrictor plate.

14. The assembly of claim 11, wherein the pressure-restrictor plate further comprises a hole for communicating a detonation cord between the blank-gun section and the loaded-gun section.

15. The assembly of claim 11, further comprising an insert coupled to the pressure-restrictor plate for aligning or securing the pressure-restrictor plate adjacent to a charge tube.

16. The assembly of claim 15, wherein the insert is positionable within an end of the charge tube.

17. The assembly of claim 11, further comprising a plurality of pressure-restrictor plates, a plurality of blank-gun sections, and a plurality of rods, wherein each of the plurality of rods is coupled to at least one of the plurality of pressure-restrictor plates and positioned within one of the plurality of blank-gun sections.

18. A method, comprising:

pressure sealing, by a pressure-restrictor plate, a blank-gun section of a partially loaded perforating gun from a loaded-gun section of the partially loaded perforating gun, the loaded-gun section including a charge tube with explosive charges and the blank-gun section excluding the charge tube, wherein the partially loaded perforating gun is positioned in a wellbore, and wherein the pressure-restrictor plate is coupled to an end of a rod extending through the blank-gun section to an end plate for maintaining the pressure-restrictor plate in position;

generating a pressure wave in the loaded-gun section; and preventing, by the pressure-restrictor plate, the pressure wave from entering the blank-gun section.

* * * * *